US010080469B2

(12) United States Patent
Oladeji

(10) Patent No.: US 10,080,469 B2
(45) Date of Patent: Sep. 25, 2018

(54) BATHING TOWEL

(71) Applicant: Oluremi Oladeji, Boonton, NJ (US)

(72) Inventor: Oluremi Oladeji, Boonton, NJ (US)

( * ) Notice: Subject to any disclaimer, the term of this patent is extended or adjusted under 35 U.S.C. 154(b) by 0 days.

(21) Appl. No.: 15/080,386

(22) Filed: Mar. 24, 2016

(65) Prior Publication Data

US 2017/0273515 A1 Sep. 28, 2017

(51) Int. Cl.

| | |
|---|---|
| ***A47K 7/02*** | (2006.01) |
| ***A47K 10/02*** | (2006.01) |
| ***A47L 13/18*** | (2006.01) |

(52) U.S. Cl.

CPC ..... *A47K 7/022* (2013.01); *A47K 10/02* (2013.01); *A47L 13/18* (2013.01)

(58) Field of Classification Search

CPC ..... A47K 7/02; A47K 7/022; A47K 10/02; A47L 13/18; A47L 13/19

USPC ..... 15/208–210.1, 227

See application file for complete search history.

(56) References Cited

U.S. PATENT DOCUMENTS

| | | | | |
|---|---|---|---|---|
| 1,334,716 A | | 3/1920 | Shont | |
| 1,533,733 A | * | 4/1925 | Gillum | A47K 7/022 15/222 |
| 3,720,205 A | | 3/1973 | Liebman | |
| 3,860,349 A | | 1/1975 | Scott | |
| 3,977,796 A | | 8/1976 | Gillespie et al. | |
| 4,422,205 A | | 12/1983 | Braxter | |
| 5,509,164 A | * | 4/1996 | Weill | A47K 7/022 15/222 |
| 6,227,742 B1 | | 5/2001 | Corn et al. | |
| 6,849,055 B1 | | 2/2005 | Williams | |
| 7,473,044 B2 | | 1/2009 | Collins | |
| 2008/0205962 A1 | | 8/2008 | Doby | |
| 2012/0152279 A1 | * | 6/2012 | Clark | A47K 7/022 134/6 |
| 2013/0227761 A1 | * | 9/2013 | Hoskins | A41D 23/00 2/207 |
| 2014/0283863 A1 | * | 9/2014 | Krenke | A45D 34/04 132/200 |

FOREIGN PATENT DOCUMENTS

| | | | | |
|---|---|---|---|---|
| GB | 2278778 A | * | 12/1994 | A47K 10/02 |
| JP | 2000-254033 A | * | 9/2000 | A47K 10/02 |
| JP | 2008-062032 | * | 3/2008 | A47K 7/02 |

* cited by examiner

*Primary Examiner* — Laura C Guidotti

(74) *Attorney, Agent, or Firm* — Michael J. Feigin, Esq.; Feigin and Fridman

(57) ABSTRACT

A towel for cleaning hard-to-reach human body areas during or after bathing. The towel comprises an elongated body comprising a front surface and a rear surface and at least one pocket disposed on each of the front surface and the rear surface, at opposing ends. The pocket is configured to receive at least a portion of a first hand of a user, and enables to clean hard-to-reach areas of the body by reaching with a finger tip of the first hand within the pocket. The towel further comprises a handle loop at a corner of the elongate body for receiving a second hand of the user. The towel when stretched by holding the pocket using the first hand and the handle loop using the second hand allows cleaning or drying a back region of the body.

3 Claims, 3 Drawing Sheets

BATHING TOWEL

BACKGROUND

1. Field of the Invention

The present disclosure generally relates to bathing towels, more specifically relates to an elongated towel with one or more pockets on either faces for cleaning and/or drying difficult to reach body areas during or after showering.

2. Description of Related Art

Bathing towels generally comprise an absorbent fabric for absorbing water from the skin surface of the body after shower. Generally, cleaning using towels involves pat drying the skin surface to wipe out the remaining water droplets. Towels exists in different sizes, textures and materials suiting to the needs of the user. Some towels comprise one or more compartments for receiving soap or shower lotion or gel, which can be used for cleaning the body during showering or bathing. Towels can also be used for other applications such as applying lotion, massaging or providing warm compress.

It has long been a problem to reach for and properly apply a cleaning agent across the back portion of the body while bathing. In addition, it is difficult to access the upper back region for cleaning or drying after shower using conventional towels. Though, a number of cleaning devices such as back scrubbers, brushes, washcloths and sponges are used for cleaning the upper back portion of human body, these devices still fail to provide options for cleaning intricate areas such as behind ears, within ear folds, between toes and the like. Moreover, it is a tedious task to clean difficult to reach body areas especially by children, elderly and other users with joint disability or upper limb disability.

Existing cleaning devices, which comprise handle loops made of hard materials on both the ends of the fabric, might hurt user's hands. Some cleaning devices may comprise rough material such as nylon net or hard fiber bristles, which might cause abrasions on skin surface. Most of the towels used for cleaning the body surface during bathing or drying the body surface after bathing, may comprise a piece of absorbent fabric. However, these towels do not allow cleaning or drying of difficult to reach body areas such as the area behind the ears, between the earlobe, between the toes and the like, while bathing.

Hence, there exists a need for an easy-to-use, compact towel for cleaning the human body including the back region of the human body. In addition, there is a need for a towel or washcloth which facilitates easy access to and cleaning of difficult-to-reach body areas including the region between toes, within the ear folds and behind the ear lobes.

SUMMARY

The present invention relates to a towel for cleaning hard-to-reach human body areas during or after bathing. The towel comprises an elongated body comprising a front surface and a rear surface and at least one pocket disposed on each of the front surface and the rear surface, at opposing ends for receiving at least a portion of a first hand of a user. The pocket enables to clean hard-to-reach areas of the body by reaching using a fingertip of the first hand within the pocket. The pocket allows delicate fingertip directed cleansing of difficult to reach or hard-to-reach body areas such as behind the earlobes, between the toes, within the ear folds and similar regions.

The towel further comprises a handle loop at a corner of the elongated body for receiving a second hand of the user.

The towel when stretched by holding the pocket using the first hand and the handle loop using the second hand allows cleaning the back region of the body using the elongate body of the towel. Thus, in addition to cleaning the hard-to-reach body areas, the towel of the present invention also allows cleaning or drying of the back region of the human body.

In an embodiment, the pockets are formed by folding back the ends of the elongate body of absorbent fabric in opposite directions and sewing along the sides of the folded portions. Pockets formed by folding back the opposing ends of the elongate body results in a continuous fabric without any borders that might interfere during cleaning. In another embodiment, the elongate body may comprise one or more fabric layers, except at folded back ends defining pocket regions. Multiple fabric layers contribute to enhanced thickness or firmness of the towel.

BRIEF DESCRIPTION OF DIFFERENT VIEWS OF THE DRAWINGS

DETAILED DESCRIPTION OF DIFFERENT EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

Figure 1A:
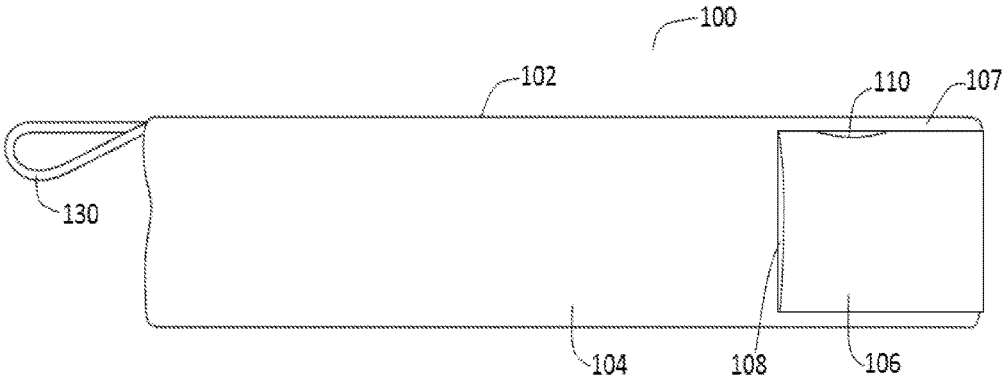
FIG. 1A is a front view of the towel.
Figure 1B:
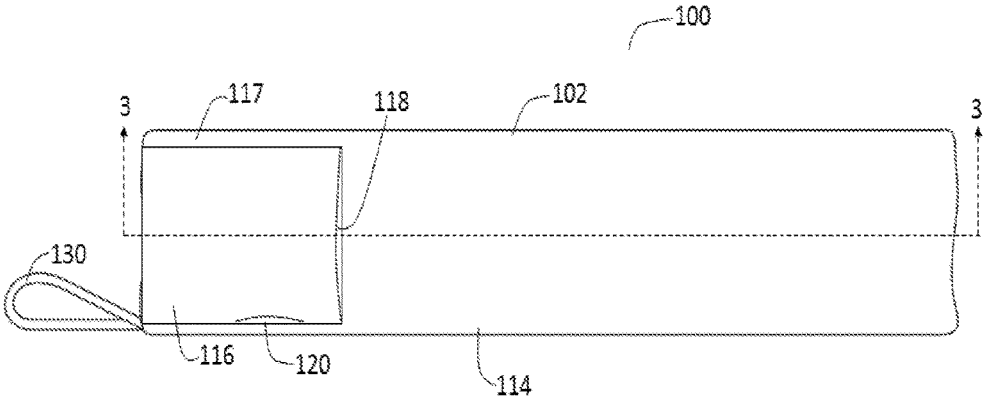
FIG. 1B is a rear view of the towel.

FIGS. 1A and 1B refers to a front surface and a rear surface respectively of the towel according to an embodiment of the present invention. The towel 100 comprises an elongated body 102 made of an absorbent fabric such as cotton terry or similar fabric. The elongated body 102 of the towel 100 comprises a front surface 104 and a rear surface 114, with a soft texture configured for cleaning and/or drying the surface of a human body. The towel 100 comprises at least one pocket disposed on opposing ends of the front surface 104 and the rear surface 114. Further, the towel 100 comprises a handle loop 130 attached to one of the corners.

FIG. 1A shows the front surface 104 of the towel 100 comprising a first pocket 106 disposed at a first end 107 of the elongate body 102. The first pocket 106 comprises a mouth portion 108 to receive a portion of a hand of a user and an opening 110 to receive the thumb of the user's hand. FIG. 1B shows the rear surface 114 of the towel 100 comprising a second pocket 116 disposed at a second end 117 of the elongate body 102. The second pocket 116 comprises a mouth portion 118 to receive a portion of a hand of a user and an opening 120 to receive the thumb of the user's hand.

The first pocket 106 or second pocket 116 enables the user to clean hard-to-reach areas of the body by reaching using a fingertip of the user's hand within the pocket. By placing the hand inside the pocket, the user can direct the outer surface of the pocket to the body area with the use of one or more fingertips and perform cleaning or drying of that particular body area. Hard-to-reach body areas may include but not limited to the area behind ears, within the ear folds, between the toes and the like. The pockets 106, 116 can also be used for holding or storing a soap bar or any cleansing agent.

In an embodiment, the first pocket 106 and second pocket 116 can be formed by folding back the opposing ends of the elongate body 102 in opposite directions and sewing the sides of the each folded portion to the elongate body 102. The pockets 106, 116 formed by folding back the opposing ends and sewing the sides of the folded portions with the elongate body 102 results in a continuous fabric without any borders that might interfere during cleaning or drying. In another embodiment, the elongate body 102 may comprise one or more fabric layers, except at folded back ends defining the pocket regions 106, 116. Multiple fabric layers contribute to enhanced thickness or firmness of the towel 100.

Figure 2:
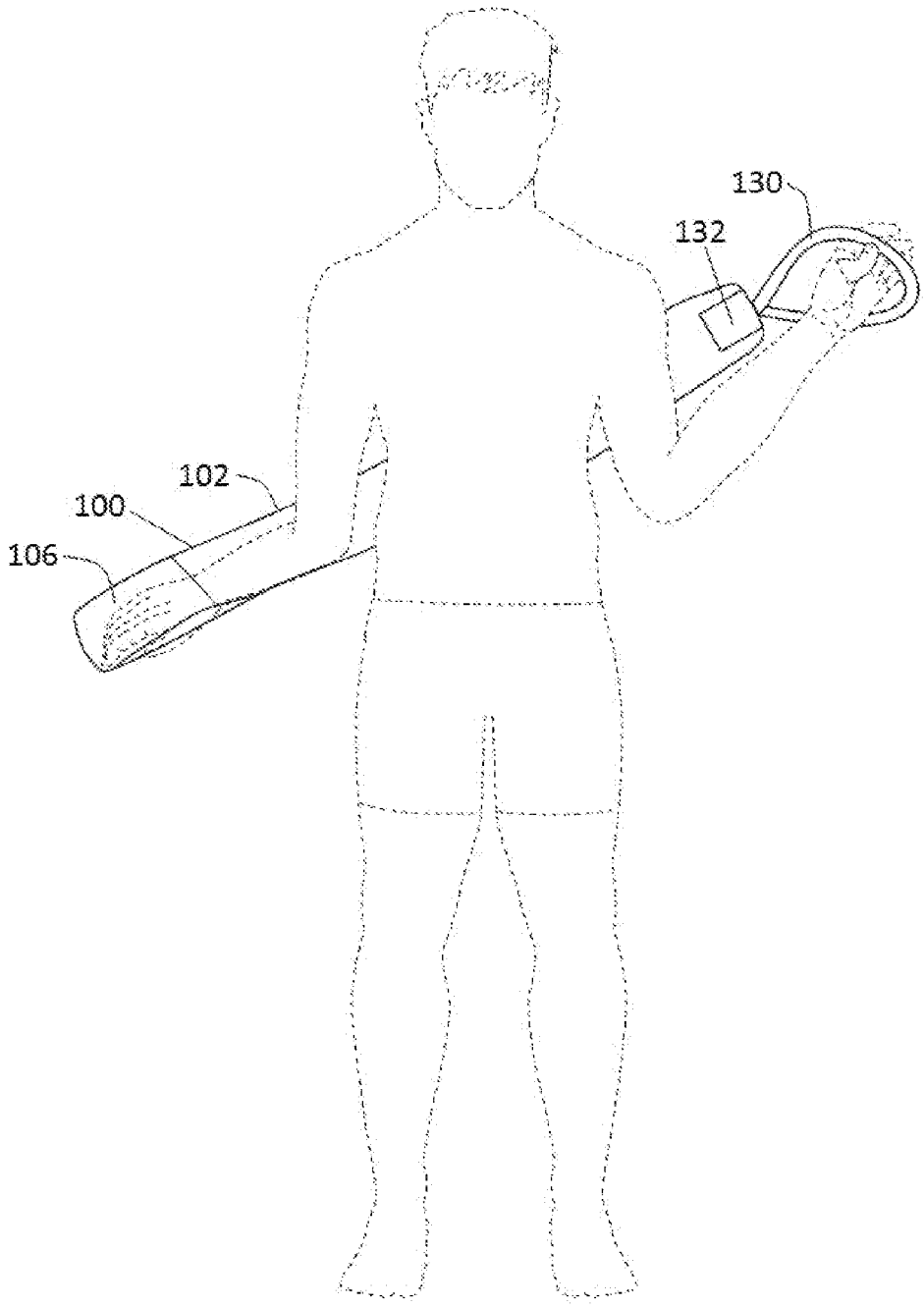
FIG. 2 is a perspective view of the towel held by a user.

FIG. 2 shows a perspective view of towel held by a user. In an embodiment, the towel enables easy and thorough cleaning of back portion of the human body. The user can hold the towel 100 in a stretched position by holding the handle loop 130 using one hand and at least a portion of the another hand inserted into the pocket 106 at an opposite end. By holding the towel 100 in the above position, the elongate body portion 102 can be used for cleaning or drying the back portion of the body. The handle loop 130 may be hidden from view by tucking inside a compartment 132. The handle loop 130 can also be hidden by inverting the pocket over the loop 130 during usage.

In an embodiment, the handle loop 130 comprises a fabric strip or ribbon sewn or attached to a corner of the elongated body 102 of absorbent fabric. The handle loop 130 can be used for holding the towel 100 using one hand and for hanging the towel 100 on a hook or a faucet for drying. The handle loop 130 can be used to hold the towel 100 while reaching for hard-to-reach areas of the body during cleaning or drying. The opening 110 for thumb allows gripping of the pocket, which allows efficient usage of the pocket.

Figure 3:
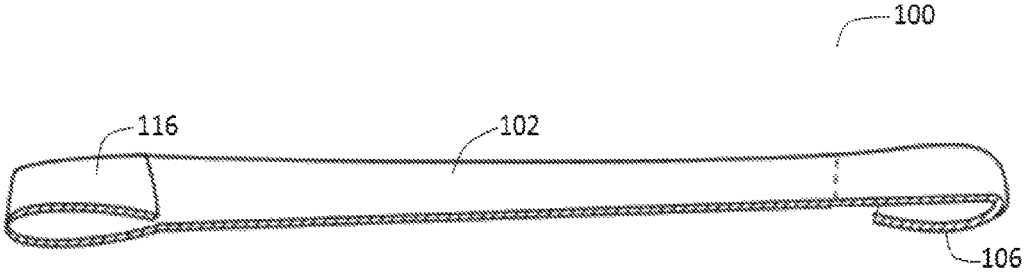
FIG. 3 is a sectional view of the towel broken along the lines 3-3 as shown in FIG. 1B.

FIG. 3 illustrates a sectional view of the towel 100 broken along the lines 3-3 as shown in FIG. 1B. The opposing ends of the elongate body 102 are folded back and sides of the folded portions sewn to form pockets 106, 116.

Traditional washcloths or bathing towels are incapable of cleaning hard-to-reach areas of the body. Whereas, the towel 100 of the present invention allows easy usage by children, elderly and other users with joint disability or upper limb disability for cleaning of difficult to reach body. The towel 100 allows users to easily reach for and clean or dry hard-to-reach areas including upper back, lower back region, behind the ears, inside the ear folds, between the toes and the like. The towel 100 can be packed snugly in any baggage during traveling.

The towel 100 of the present invention may comprise different dimensions according to the users and their needs. In an exemplary embodiment, the towels designed for Toddlers may comprise a size of 14"×5 or 16"×5" and 5" pockets with a thumb opening at 2.5-4" position. Towels for Children may comprise a size of 18"×6" or 16"×6" and 6" pockets with a thumb opening at 3-5" position. Adult size towels may comprise a size of 18"×6" or 20"×6" and 6" pockets with the thumb opening at 3-5" position. Large size towels may comprise a size of 20"×6" or 22"×6" and 6" pockets with the thumb opening at 3-5" position. Extra-large for big and tall users may comprise a size of 24"×7" or 26"×7" and 7" pockets with thumb opening at 4-6" position.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

What is claimed is:

1. A towel comprising:

a single continuous length of material forming an elongated body with a front surface and a rear surface;

a pocket formed from, and situated on, a portion of said front surface created by folding an end of said elongated body and stitching sides of said end of said elongated body to said front surface thereof;

a pocket formed from, and situated on, a portion of said rear surface created by folding an end of said elongated body and stitching sides of said end of said elongated body to said front surface thereof;

wherein said pocket comprises two portals, a first of said two portals larger than a second of said two portals, said first portal opening a direction of said continuous length of material, and said second portal opening a direction perpendicular to said continuous length of material.

2. A towel comprising:

a single length of material with a front and back side;

a first pocket at a first end formed from folding said front side of said single length of material towards itself and attaching said first end to an unfolded portion of said single length of material; and a second pocket at a second end formed from folding said back side of said single length of material towards itself and attaching said second end to an unfolded portion of said single length of material;

wherein said first pocket and said second pocket are on opposite ends of said single length of material; and a width of said first pocket and said second pocket is less than that of said single length of material, said first pocket and said second pocket being centered on said length of material.

3. A towel comprising:

stitching at equal and opposite distances from extreme ends of a length of material;

two pockets open on exactly two sides and closed, at least partially, by said stitching on one of said exactly two sides while completely open on a second of said exactly two sides;

wherein one pocket of said two pockets is only on a first side of said length of material and another pocket of said two pockets is only on a second and opposite side to said first side of said length of material and each pocket extends only partially along a width of said length of material wherein a width is perpendicular to said length of said material.

* * * * *